US012741306B2

(12) United States Patent
Voges et al.

(10) Patent No.: US 12,741,306 B2
(45) Date of Patent: Sep. 22, 2026

(54) METHOD OF DESCALING HEAVY GAGE SHEET METAL COILS AND HEAVY GAGE INDIVIDUAL SHEETS OF SHEET METAL

(71) Applicant: Lloyds Engineering Works Limited, Mumbai (IN)

(72) Inventors: Kevin Voges, Red Bud, IL (US); Alan Mueth, Red Bud, IL (US)

(73) Assignee: Lloyds Engineering Works Limited, Mumbai (IN)

( * ) Notice: Subject to any disclaimer, the term of this patent is extended or adjusted under 35 U.S.C. 154(b) by 355 days.

(21) Appl. No.: 18/520,760

(22) Filed: Nov. 28, 2023

(65) Prior Publication Data

US 2025/0170631 A1 May 29, 2025

(51) Int. Cl.

| | |
|---|---|
| ***B21B 45/06*** | (2006.01) |
| ***B21B 15/00*** | (2006.01) |
| ***B21B 33/00*** | (2006.01) |
| ***B21B 39/00*** | (2006.01) |

(52) U.S. Cl.

CPC ..... *B21B 45/06* (2013.01); *B21B 15/0007* (2013.01); *B21B 33/00* (2013.01); *B21B 39/006* (2013.01); *B21B 2015/0064* (2013.01)

(58) Field of Classification Search

CPC ..... B24C 1/086; B24C 3/14; B21B 45/06
See application file for complete search history.

(56) References Cited

U.S. PATENT DOCUMENTS 1,819,763 A * 8/1931 Blecker ..... B21B 1/24 72/200
2,196,600 A * 4/1940 Wean ..... B21B 45/06 266/112
3,292,402 A 12/1966 O'Brien
3,686,921 A * 8/1972 Roper ..... B21D 1/00 72/183
4,751,838 A 6/1988 Voges
(Continued)

FOREIGN PATENT DOCUMENTS

JP H-2133124 5/1990

OTHER PUBLICATIONS

The Union Tool Corporation, "Automatic Feeder / De-Stacker For Steel Sheets and Plates", Product Bulletin, 2 pages, found at https://www.uniontoolcorp.com/pdfs/Sheet_Steel_Feeder_PB8582.pdf, visited in 2023.

*Primary Examiner* — Jason L Vaughan
(74) *Attorney, Agent, or Firm* — Thompson Coburn LLP

(57) ABSTRACT

Coils of sheet metal and individual sheets of sheet metal having a thickness of greater than 0.074 inches are descaled in a processing line. The processing line has a cut to length portion, a conveyor, a destacker, and an apparatus for descaling the sheet metal by propelling one of grit and slurry against the sheet metal using an impeller wheel. The descaling apparatus has pinch rollers in an interior of the descaling apparatus. The processing line is configurable for processing a coil format by directing the sheet metal from the cut to length portion of the processing line through the descaling apparatus via the conveyor without processing through the destacker. The processing line is alternatively configurable for processing individual sheets of the sheet metal by directing the sheet metal from the destacker through the descaling apparatus via the conveyor without processing in the cut to length portion.

12 Claims, 5 Drawing Sheets

Fig. 5

(56) References Cited

U.S. PATENT DOCUMENTS

| | | | | |
|---|---|---|---|---|
| 4,768,280 | A * | 9/1988 | Palmer | B21C 37/0807 118/317 |
| 4,998,338 | A * | 3/1991 | Seidel | B21B 1/26 29/33 Q |
| 5,412,966 | A * | 5/1995 | Neese | B21B 38/00 72/39 |
| 5,879,465 | A * | 3/1999 | McKevitt | C23G 3/023 134/41 |
| 6,814,815 | B2 * | 11/2004 | Voges | B08B 1/34 134/42 |
| 7,077,724 | B1 * | 7/2006 | Voges | B21B 45/08 134/198 |
| 7,143,499 | B2 * | 12/2006 | Seidel | B21B 1/466 164/476 |
| 7,500,298 | B2 * | 3/2009 | Love, III | B24C 1/086 29/81.09 |
| 7,601,226 | B2 | 10/2009 | Voges et al. | |
| 8,062,095 | B2 | 11/2011 | Voges et al. | |
| 8,066,549 | B2 | 11/2011 | Voges et al. | |
| 8,074,331 | B2 | 12/2011 | Voges | |
| 8,128,460 | B2 | 3/2012 | Voges et al. | |
| 9,333,625 | B1 | 5/2016 | Voges | |
| 2005/0198794 | A1 * | 9/2005 | Love, III | B24C 3/12 29/81.08 |
| 2006/0053617 | A1 * | 3/2006 | Richert | B21B 1/28 29/527.7 |
| 2019/0337036 | A1 | 11/2019 | Voges | |
| 2022/0362824 | A1 | 11/2022 | Cantrell et al. | |

* cited by examiner

METHOD OF DESCALING HEAVY GAGE SHEET METAL COILS AND HEAVY GAGE INDIVIDUAL SHEETS OF SHEET METAL

BACKGROUND AND SUMMARY

The present disclosure relates to methods for descaling heavy gage steel coils and sheet stock, for instance, having a thickness of between 0.074 inches (1.8 mm) and 1.0 inch (25.4 mm). When the format is coils of heavy gage sheet metal, the processing line may be aligned in a first configuration where the coils are aligned in a cut-to-length and/or blanking portion of the processing line that uncoils the sheet material, levels it, and cuts it to the required length, and then descales it. When the format is individual sheets of heavy gage sheet metal, the processing line may be aligned in a second configuration where the sheets are arranged in a destacker and then descaled.

DETAILED DESCRIPTION

Figure 1:
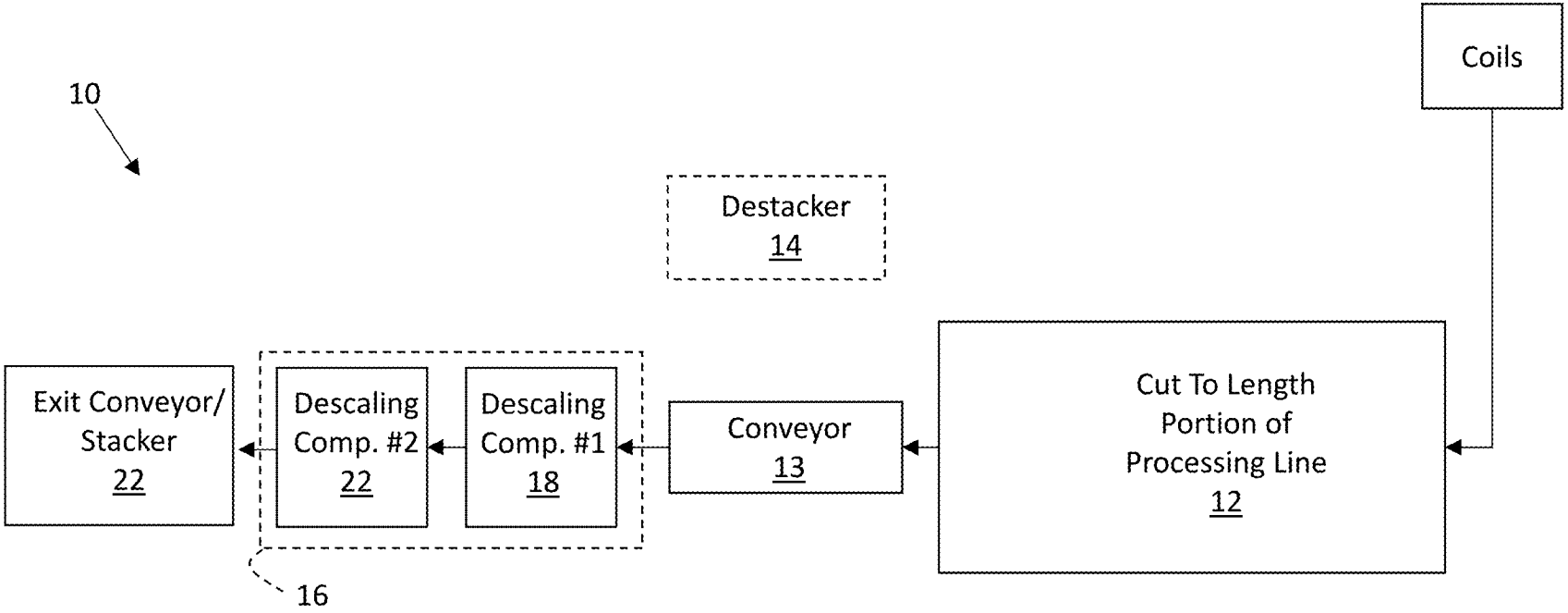
FIG. 1 illustrates a processing line aligned in a first configuration for a coil format.

An exemplary processing line 10 is shown generally in FIGS. 1-5, and includes a cut to length portion 12 followed by conveyor 13, followed by a destacker 14, followed by a descaling cell 16 comprising first and second descaling components 18,20, and followed by an exit conveyor or stacker 22, as desired. The cut to length portion may include all equipment for uncoiling a coil of sheet metal, straightening and flattening the sheet metal and then cutting the sheet metal to a desired length. As described in more detail below, the cut-to-length and/or blanking portion of the processing line levels the coil of heavy gage sheet metal and cuts it length to a desired size with a shear 24. A temper mill 26 or a stretcher leveler 28 may be used or may be used to straighten, level and flatten the heavy gage sheet metal.

Figure 4:
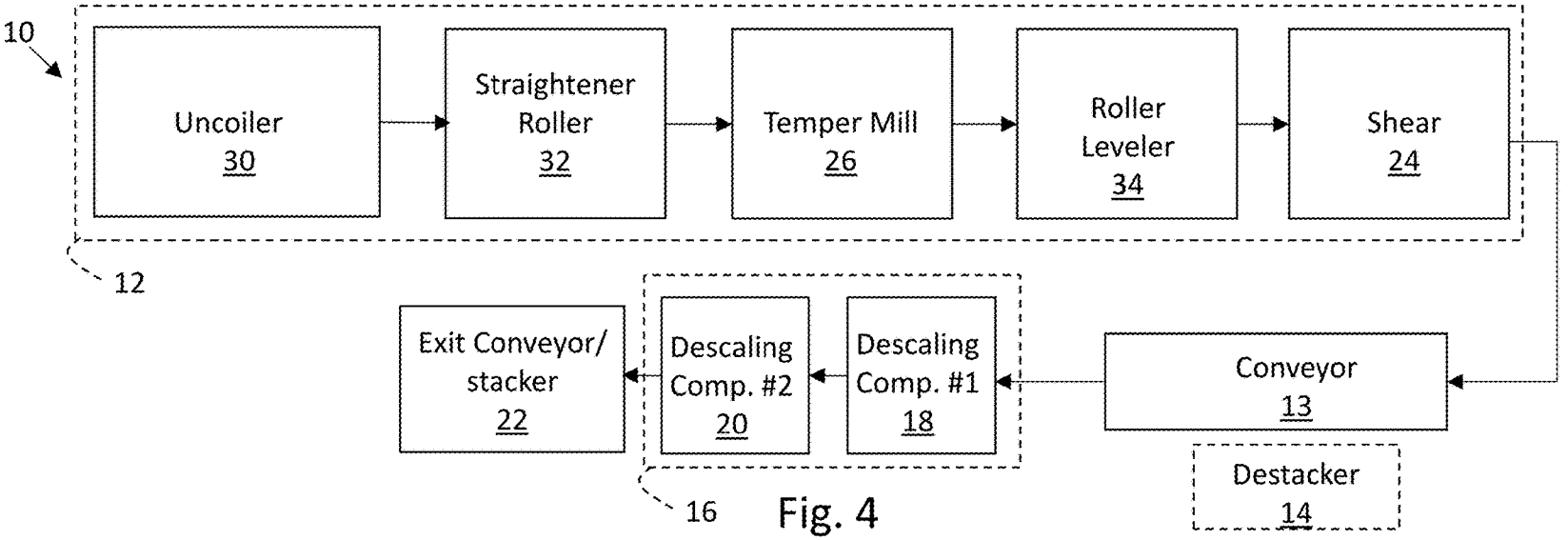
FIG. 4 is a process flow diagram for the first configuration using a temper mill arrangement in the cut to length portion of the processing line.

As shown in FIG. 4, the cut to length portion 12 of the processing line 10 may include an uncoiler 30, a straightener roller 32, the temper mill 26, the roller leveler 34, and the shear 24. The straightener roller 32 is positioned just downstream of the uncoiler 30. The straightener roller 32 includes a plurality of upper rollers and lower rollers having a relatively large diameter. At least some of the rollers are powered to withdraw the sheet metal strip from the coil at a uniform velocity. The upper and lower rollers are positioned relative to one another to put a deep reverse bend in the sheet sufficient to reverse any coil set. The uncoiler 30 and straightener roller 32 are conventional. After the straightener roller 32, the temper mill 26, and if desired the roller leveler 34, are provided. The general description of the temper mill 26 is described in U.S. Pat. No. 3,292,402, which is incorporated herein by reference. The temper mill 26 eliminates randomly trapped internal stresses by elongating the material beyond its yield point by squeezing the material between two rolls with enough force to reduce its thickness. The temper mill 26 may be a 4 high or 2 high mill temper mill capable of handling sheets having a gage thickness of between 0.074 inches (1.8 mm) and 1.0 inches (25.4 mm). The temper mill 26 may be configured to generate 75 kpsi maximum rolling stress and 2.5% elongation. The roller leveler 34 may be provided in conjunction with the temper mill 26 to further enhance the flatness of relatively thin gages of sheet metal material. Depending upon the application, the roller leveler 34 and the temper mill 26 may be used together to correct the shape of the sheet metal material. While the temper mill 26 may stress relieve the sheet metal material, the roller leveler 34 may be needed to provide additional flatness for the sheet metal material. The roller leveler 34 may also be necessary to remove defects such as edge wave or center buckle. The roller leveler 34 may be used to bend the sheet metal material progressively up and down over rolls of sufficient diameter to stretch the outer and inner surfaces of the material past the yield point. The roller leveler 34 may also be used to selectively stretch the sheet metal material from side to side. The roller leveler 34 may be used without the temper mill 26 depending upon the condition of the continuous length of sheet metal. The roller leveler is conventional. After the roller leveler 34, the processing line of FIG. 4 includes the shear 24. The shear 24 may comprise a rotary shear. A rotary shear has proven effective for use in a temper mill cut-to-length blanking line where the sheet metal strip is continuously fed through the line. The shear is conventional.

Figure 5:
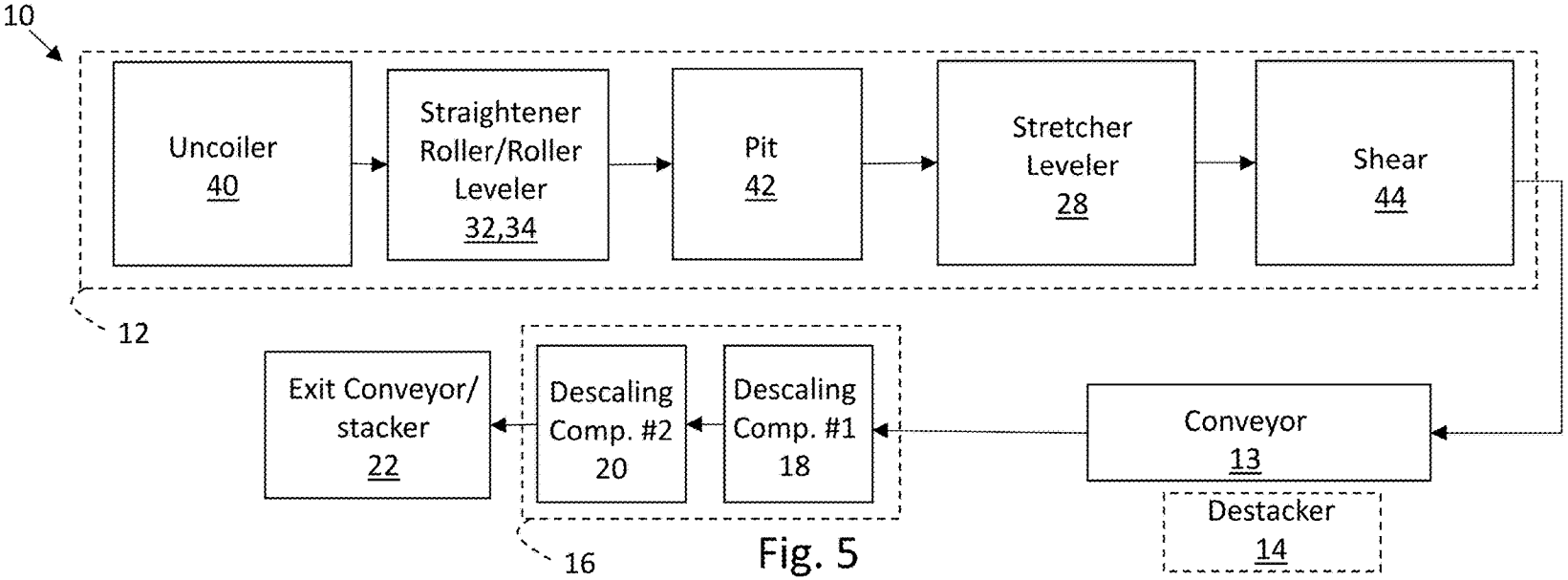
FIG. 5 is a process flow diagram for the first configuration using a stretcher leveler arrangement in the cut to length portion of the processing line.

As shown in FIG. 5, an alternate arrangement of the cut to length portion of the processing line may include an uncoiler 40, the straightener roll 32 or the roller leveler 34 as described previously, a loop pit 42, the stretcher leveler 28, and a shear 44. The loop pit 42 is positioned just downstream of the the straightener roll 32 or the roller leveler 34, as the case may be, and prior to the stretcher leveler 28. As the sheet metal material is advanced incrementally through the stretcher leveler 28 during successive stretching operations, the loop or take up pit 42 allows the strip to accumulate during short periods of time as the portions of the sheet metal strip are advancing incrementally through the stretcher leveler. The uncoiler 40 and loop pit 42 are conventional. The general description of the stretcher leveler 28 is described in U.S. Pat. No. 4,751,838, which is incorporated herein by reference. The stretcher leveler 28 stretches the material sufficiently to exceed the yield point in all the fibers of the strip from top to bottom and from edge to edge thus equalizing internal trapped stresses throughout the material. The stretcher leveler 28 may include a plurality of powered rollers for pulling the sheet metal strip through the stretcher leveler. A feeding mechanism of the stretcher leveler may advance the sheet metal strip through the stretcher leveler at precisely measured increments. Generally speaking, the stretcher leveler consists of a pair of entry and exit frames that are adjustable relative to the desired length of the segment to be stretched. During stretching, each frame grips the segment to be stretched across its width. Large hydraulic cylinders extend between the two frames. When pressurized, the cylinders push the frames away from one another thereby stretching the segment clamped therebetween. The segment is subsequently stretched in the direction of travel. After the stretcher leveler 28, the shear 44 may be provided. The shear 44 may comprise a direct drive mechanical shear. A direct drive mechanical shear has proven effective for use with thicker gage materials in a stretcher leveler cut-to-length blanking line where the sheet metal strip is incrementally fed through the line. The direct drive mechanical shear is conventional.

Figure 2:
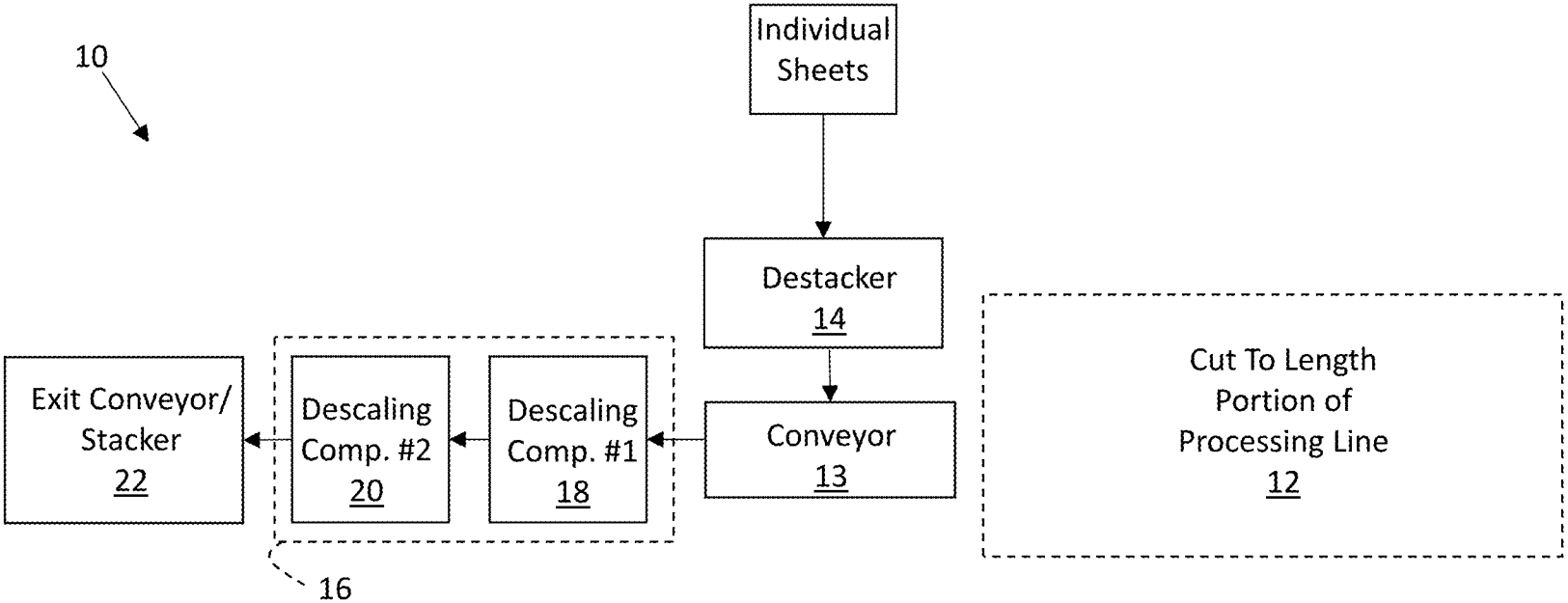
FIG. 2 illustrates a processing line aligned in a second configuration for an individual sheet format.
Figure 3:
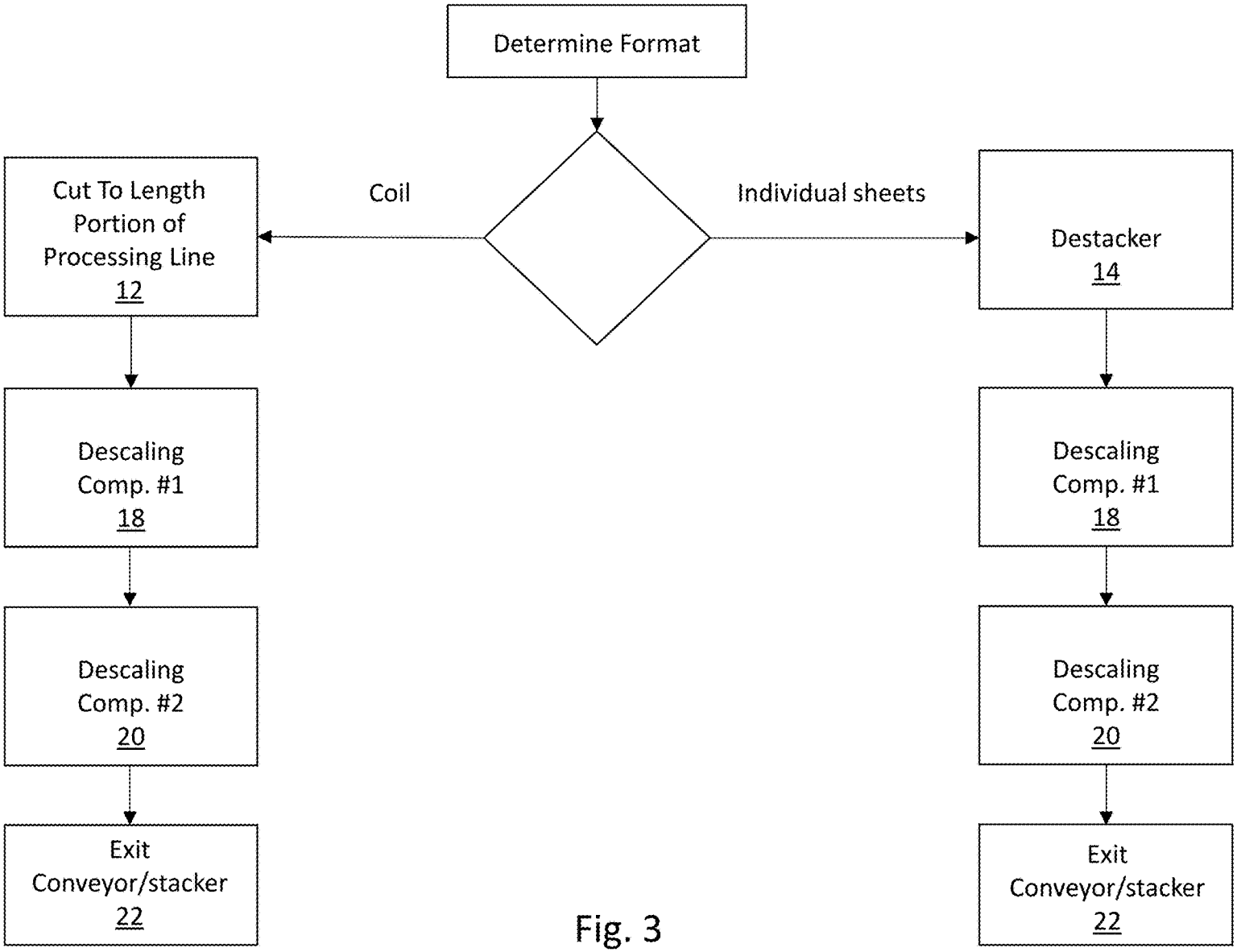
FIG. 3 is a process flow diagram for aligning the processing line in the first or second configuration.

The next items in the processing line are sequentially the conveyor 13, the destacker 14 and the descaling cell 16. The conveyor 13 is conventional. The general description of a descaling cell 16 with descaling components 18,20 is described in U.S. Pat. App. Pub. No. 2022-0362824, the disclosure of which is incorporated by reference herein. A destacker 14 may be a sheet plate and sheet feeder, for instance, a model no. PB8582 provided by The Union Tool Corporation of Warsaw, Indiana (see https://www.uniontoolcorp.com/pdfs/Sheet_Steel_Feeder_PB8582.pdf). In the first configuration with the format comprising a coil of heavy gage sheet metal, after the shear 24, the cut-to length sheets of sheet metal may be directed directly to the descaling cell 16 via the conveyor 13 bypassing the destacker 14. As shown in FIG. 2, in the second configuration with the format comprising individual sheets of sheet metal, the cut to length portion 12 of the processing line 10 may be bypassed and the sheets loaded onto the destacker 14 and directed to the descaling cell 16 via the conveyor 13.

Figure 6:
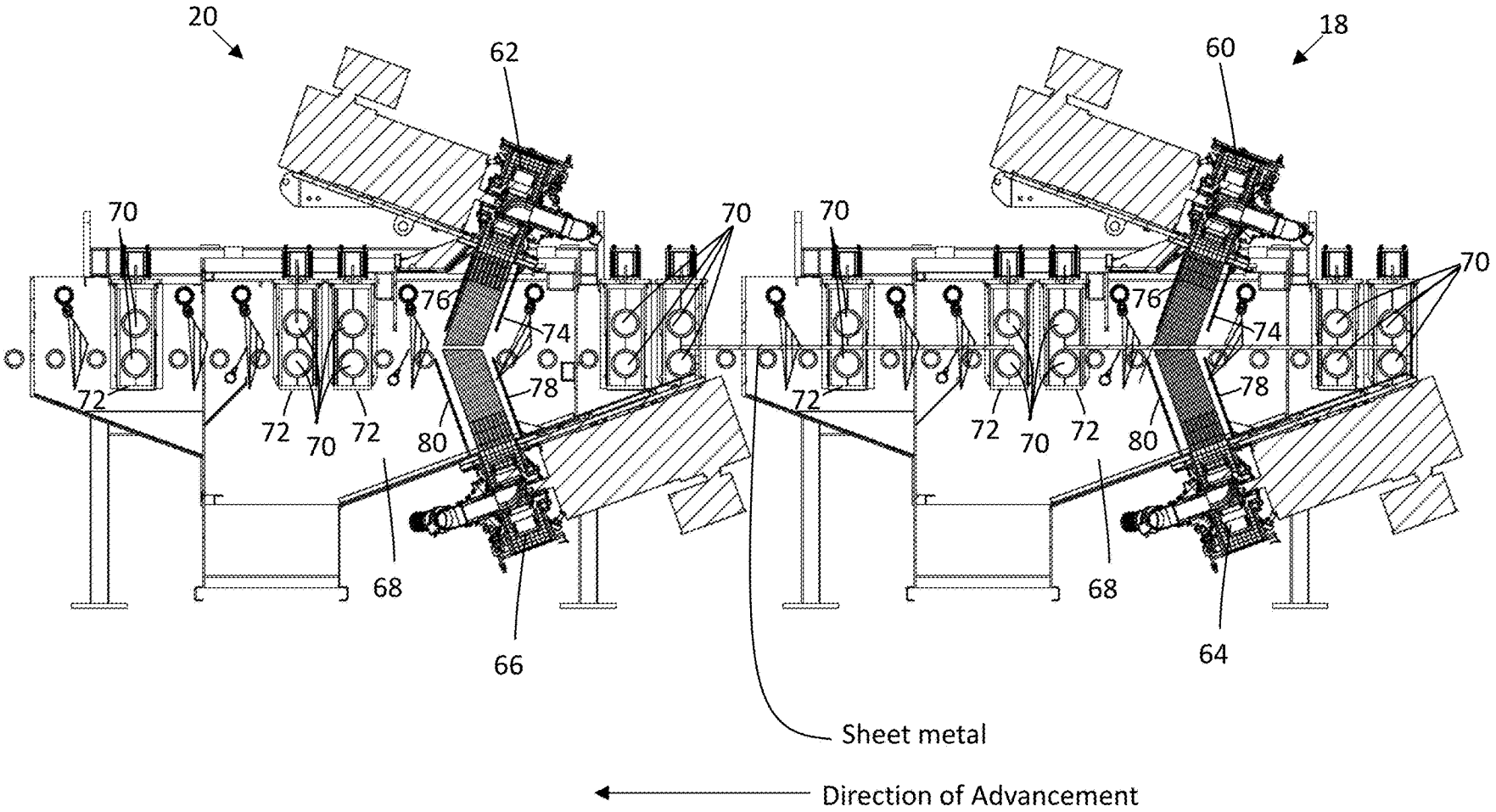
FIG. 6 is a side cross sectional view of a descaling portion of the processing line.

FIG. 6 shows exemplary first and second descaling components 18,20 arranged adjacent to each other in series to form the descaling cell. The descaling components 18,20 may be as described in more detail in U.S. Pat. App. Pub. No. 2022-0362824. The descaling components 18,20 descale the top and bottom surfaces of the sheet metal with a scale removing media. The scale removing media may include a slurry comprising a grit and liquid. The scale removing media may also comprise a grit. Both of the descaling components 18,20 are constructed in the same manner, with the exception that the single top mounted slurry propelling impeller wheel 60 of one of the descaling components 18 is arranged adjacent one lateral side of the sheet metal being processed (e.g., the operator side of the processing line), and the single top mounted slurry propelling impeller wheel 62 of the other of the descaling components 20 is arranged adjacent the opposite lateral side of the sheet metal being processed (e.g., the drive side of the processing line). In a like manner, the single bottom mounted slurry propelling impeller wheel 64 of one of the descaling components 18 is arranged adjacent one lateral side of the sheet metal being processed (e.g., the operator side of the processing line), and the single bottom mounted slurry propelling impeller wheel 66 of the other of the descaling components 20 is arranged adjacent the opposite lateral side of the sheet metal being processed (e.g., the drive side of the processing line). Each descaling component 18,20 comprises a hollow enclosure 68. An upstream or front end of the enclosure has a narrow entrance opening slot to receive the width and thickness of the length of sheet metal. An opposite downstream or back end of the enclosure has a narrow slot exit opening that is also dimensioned to receive the width and thickness of the length of sheet metal. The openings are equipped with sealing devices engineered to contain the slurry within the enclosure or box during the processing of the sheet metal. The descaling component enclosure also has a top, a bottom, and first and second lateral sides that define an interior of the enclosure. The bottom of the enclosure is formed with a discharge chute communicating with the interior of the enclosure. The discharge chute allows the discharge of material removed from the length of sheet metal and the collection of used slurry from the interior of the enclosure. Each descaling component is provided with the top mounted motor driven slurry propelling impeller 60,62 adapted and configured to propel slurry into the enclosure interior onto a top surface of the sheet metal across an entire width of the sheet metal in a direction extending from one lateral side toward the opposite lateral side of the sheet metal passing through the enclosure interior. Each descaling component is also provided with a single motor driven slurry propelling impeller 64,66 mounted on the bottom of the enclosure that is adapted and configured to propel slurry into the enclosure interior onto a bottom surface of the sheet of metal across the entire width of the sheet of metal.

As described in applicant's previous patents, preferably, the top surface and/or bottom impellers rotate to generate a slurry discharge velocity below 200 feet per second. More preferably, the slurry discharge velocity is in a range of about 100 feet per second to 200 feet per second. Even more preferably, the slurry discharge velocity is in a range of about 130 feet per second to 150 feet per second. In order to generate sufficient slurry flow to the descaling components to remove substantially all of the scale from the surfaces from the sheet metal, it is necessary to generate between at least 1300 pounds per minute of grit flow per blasting wheel. A preferred range is from about 1300 pounds per minute to about 5000 pounds per minute of grit flow per blasting wheel. A grit flow rate of at least 1700 pounds per minute has proven effective. To generate this flow rate, each descaling component includes one primary eductor feed pump 90 (FIGS. 10-12) which generates a flow rate of 1,500 gallons per minute flowing through a 10 inch diameter inlet pipe. The eductor feed pump 90 may have a rating of 200 hp, 1750 rpm, and 150 psi at 1,500 gpm. The eductor feed pump 90 directs its 1,500 per gallon flow rate to a manifold 92 with two outputs, one of which is directed to the inlet of the single top mounted impeller and the other of which is directed to the inlet of the single bottom mounted impeller.

To enable the heavy gage thickness of sheets (whether produced in the cut to length portion of the processing line in the first configuration or provided in an individual sheet format in the second configuration), the descaling components 18,20 are provided with pinch rollers 70 in the interior of the enclosure. Not in any limiting sense, but as shown in the drawings, each descaling component 18,20 is provided with 5 sets of pinch rollers 70. The pinch rollers 70 draw the sheets of sheet metal into the descaling component 18, 20 and through the descaling cell 16 either directly from the shear or the destacker as described above. In conventional arrangements of the descaling cell 16, for instance, as described in U.S. Pat. Nos. 7,601,226, 8,062,095, 8,066,549, 8,074,331, and 8,128,460, the sheets of sheet metal are pushed or pulled through the descaling cells with drive rollers located outside of the enclosures. Given the heavy gage thickness of the sheets of sheet metal, this arrangement has proven ineffective. In the harsh environment created by the slurry and the scale material removed from the surfaces of the sheet metal, the pinch rollers 70 are enclosed in a dedicated housing 72 and also shielded from the blast pattern on the impeller wheels by shrouds 74,76,78,80 formed in the interior of the housing. Forward and rear upper shrouds 74,76 project from the top of the enclosure adjacent the respective impeller wheel 60,62 and prevent the blast pattern from the top mounted impeller wheel from interfering with the pinch rollers 70. Forward and rear bottom shrouds 78,80 project from the bottom of the enclosure adjacent the respective impeller wheel and prevent the blast pattern from the bottom mounted impeller wheel from interfering with the bottom pinch rollers. The forward and rear upper shrouds 74,76 and the forward and rear bottom shrouds 78,80 are provided in each enclosure of each descaling cell.

Thus, depending on the format, the processing line 10 may be configured in the first or second configuration. However, in either the first or second configuration, the individual sheets of sheet metal may be directed through the descaling cell 16. Such a processing line 10 allows flexibility in processing depending upon the format, and combines both options to produce descaled, rust inhibitive sheets of metal. The raw material cost for individual sheets of sheet metal and coil tends to vary. Such a processing line accommodates variation in raw material cost by providing one line to process both formats which avoids the need to provide two different processing lines each with a slurry blasting descaling cell as set forth in U.S. Pat. App. Pub. No. 2022-0362824, or U.S. Pat. Nos. 7,601,226, 8,062,095, 8,066,549, 8,074,331, and 8,128,460, that is, a cut-to-length processing line with a slurry blasting descaling cell, and a sheet processing line with a slurry blasting descaling cell. Further, the processing line 10 described herein avoids the need to provide a terminal coiling apparatus for coil formats. A terminal coiling apparatus for heavy gage sheet metal coils is a very expensive option costing nearly $22 million dollars.

In accordance with a method involving the aforementioned processing line, a format of sheet metal may be determined. Based upon the determination of the format of the sheet metal, the processing line may be configured in one of two configurations. When the format comprises coiled sheet metal material having a thickness in excess of 0.074 inches, the processing line may be configured in a configuration such as shown in FIG. 4 that directs the continuous length of sheet metal from the uncoiler 30 through the straightener roller 32, the temper mill 26, the roller leveler 34, and the shear 24 to the descaling cell 16 via the conveyor 13 without passing through the destacker 14. Also, when the format comprises coiled sheet metal material having a thickness in excess of 0.074 inches, the processing line 10 may be configured in a configuration such as shown in FIG. 5 that directs the continuous length of sheet metal from the uncoiler 40, the loop pit 42, the stretcher leveler 28, and the shear 44 to the descaling cell 16 via the conveyor 13 without passing through the destacker 14. When the format comprises individual sheets of sheet metal having a thickness in excess of 0.074 inches, the processing line 10 may be configured as shown in FIG. 2 such that the continuous length of sheet metal is directed from the destacker 14 to the descaling cell 16 via the conveyor 13 without passing through the cut-to-length portion 12 of the processing line.

As to the configuration of the processing line, the operator of the line may perform the steps of configuring the line based upon the operator's determination of the coil format, coil condition, and ultimate material requirements in the manner described above. In the alternative, the operator of the line may receive instructions from another in selecting and configuring the processing line based upon coil format, coil, and ultimate material requirements. For instance, an operator of the processing line may receive instructions to configure the line in connection with the installation of a destacker 14 in an existing cut-to-length and descaling processing line. By way of example and not in any limiting sense, a conveyor 13 and/or destacker 14 and may be retrofitted in an existing cut-to-length and descaling processing line, and the operator of the line may receive instructions for processing the continuous length of sheet metal in the line from an integrator, a provider of the conveyor 13 and/or destacker 14, a process improvement consultant, or a retrofitting contractor. The operator may also receive instructions from a provider of a processing line comprising cut-to-length and descaling portions of the processing line.

In view of the foregoing, it will be seen that the several advantages of the invention are achieved and attained. The embodiments were chosen and described in order to best explain the principles of the disclosure and their practical application to thereby enable others skilled in the art to best utilize the principles in various embodiments and with various modifications as are suited to the particular use contemplated. As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of descaling coils of sheet metal and individual sheets of sheet metal in a processing line, wherein the sheet metal has a thickness of greater than 0.074 inches, wherein the processing line has a cut to length portion, a conveyor, a destacker, and an apparatus adapted and configured to descale the sheet metal by propelling one of grit and slurry against the sheet metal using an impeller wheel, the descaling apparatus having a plurality of pinch rollers in an interior of the descaling apparatus, the method comprising:

configuring the processing line in a first configuration for processing a coil format of the sheet metal by directing the sheet metal from the cut to length portion of the processing line through the descaling apparatus via the conveyor without processing through the destacker; including drawing the sheet metal through the descaling apparatus with the pinch rollers; and configuring the processing line in a second configuration for processing individual sheets of the sheet metal by directing the sheet metal from destacker through the descaling apparatus via the conveyor without processing in the cut to length portion, including drawing the sheet metal through the descaling apparatus with the pinch rollers.

2. The method of claim 1 further comprising arranging shrouds to project into the interior of the descaling apparatus from an area adjacent the impeller wheel in a manner to restrict a blast pattern of the one of the grit and slurry generated by the impeller wheel from interfering with operation of the pinch rollers.

3. The method of claim 1 wherein the cut to length portion of the processing line includes an uncoiler followed by a temper mill followed by a shear; and the step of configuring the processing line in the first configuration includes:

directing the continuous length of the sheet metal from the uncoiler through the temper mill and the shear to the descaling apparatus via the conveyor.

4. The method of claim 1 wherein the cut to length portion of the processing line includes an uncoiler followed by a loop pit followed by a stretcher leveler followed by a shear; and the step of configuring the processing line in the first configuration includes:

directing the continuous length of the sheet metal from the uncoiler through the loop pit, the stretcher leveler, and the shear to the descaling apparatus via the conveyor.

5. A method of descaling coils of sheet metal and individual sheets of sheet metal in a processing line, wherein the sheet metal has a thickness of greater than 0.074 inches, wherein the processing line has a cut to length portion, a conveyor, a destacker, and an apparatus adapted and configured to descale the sheet metal by propelling one of grit and slurry against the sheet metal using an impeller wheel, the descaling apparatus having a plurality of pinch rollers in an interior of the descaling apparatus, the method comprising:

determining a format of the sheet metal;

configuring the processing line in a first configuration when the determination of the format indicates a coil format of the sheet metal, including directing the sheet metal from the cut to length portion of the processing line through the descaling apparatus via the conveyor without processing through the destacker, including drawing the sheet metal through the descaling apparatus with the pinch rollers; and configuring the processing line in a second configuration when the determination of the format indicates individual sheets of the sheet metal, including by directing the sheet metal from the destacker through the descaling apparatus via the conveyor without processing in the cut to length portion, including drawing the sheet metal through the descaling apparatus with the pinch rollers.

6. The method of claim 5 further comprising arranging shrouds to project into the interior of the descaling apparatus from an area adjacent the impeller wheel in a manner to restrict a blast pattern of the one of the grit and slurry generated by the impeller wheel from interfering with operation of the pinch rollers.

7. The method of claim 5 wherein the cut to length portion of the processing line includes an uncoiler followed a temper mill followed by a shear; and the step of configuring the processing line in the first configuration includes:

directing the continuous length of the sheet metal from the uncoiler through the temper mill and the shear to the descaling apparatus via the conveyor without processing through the destacker.

8. The method of claim 5 wherein the cut to length portion of the processing line includes an uncoiler followed by a loop pit followed by a stretcher leveler followed by a shear; and the step of configuring the processing line in the first configuration includes:

directing the continuous length of the sheet metal from the uncoiler through the loop pit, the stretcher leveler, and the shear to the descaling apparatus via the conveyor.

9. A processing line for sheet metal having a thickness of greater than 0.074 inches, the processing line having an uncoiler, one of a temper mill and a stretcher leveler, a shear, a conveyor, a destacker, and a descaling apparatus, the descaling apparatus being adapted and configured to descale the sheet metal by propelling one of grit and slurry against the sheet metal using an impeller wheel, the descaling apparatus having a plurality of pinch rollers in an interior of the descaling apparatus, the processing line being configurable in one of a first and second configuration based upon a format of the sheet metal, wherein in the first configuration with the format of the sheet metal comprising a coil of sheet metal, the processing line is adapted and configured to direct the sheet metal from the uncoiler through the one of the temper mill and the stretcher leveler, through the shear and through the descaling cell via the conveyor without processing through the destacker, wherein in the second configuration with the format of the sheet metal comprising individual sheets of the sheet metal, the processing line is adapted and configured to direct sheet metal from the destacker to the descaling apparatus via the conveyor without processing through the uncoiler, the one of the temper mill and stretcher level, and the shear, wherein the pinch rollers are adapted and configured to draw the sheet metal through the descaling apparatus in the first configuration and the second configuration.

10. The processing line of claim 9 further comprising shrouds, the shrouds projecting into the interior of the descaling apparatus from an area adjacent to the impeller wheel, the shrouds being configured in a manner to restrict a blast pattern of the one of the grit and slurry generated by the impeller wheel from interfering with operation of the pinch rollers.

11. The processing line of claim 10 wherein the descaling apparatus comprises two enclosures arranged in series, and for each enclosure, the impeller wheel comprises only one impeller wheel mounted on the top of the enclosure and only one other impeller wheel mounted on the bottom of the enclosure.

12. The processing line of claim 11 wherein for each enclosure of the descaling apparatus, the shrouds projecting into the interior of the descaling apparatus from an area adjacent the impeller wheel comprise forward and rearward shrouds adjacent the only one impeller wheel mounted on the top of the enclosure, and forward and rearward shrouds adjacent the only one other impeller wheel mounted on the bottom of the enclosure.

* * * * *